United States Patent [19]

Walker

[11] Patent Number: 4,887,819

[45] Date of Patent: Dec. 19, 1989

[54] CASINO BOARD GAME

[76] Inventor: John A. Walker, 663 Lefferts Ave., Brooklyn, N.Y. 11203

[21] Appl. No.: 605,811

[22] Filed: May 1, 1984

[51] Int. Cl.[4] ..... A63F 3/00

[52] U.S. Cl. ..... 273/256; 273/274

[58] Field of Search ..... 273/256, 274, 243, 248

[56] References Cited

U.S. PATENT DOCUMENTS

| | | | |
|---|---|---|---|
| 3,674,273 | 7/1972 | Sells | 273/248 |
| 3,759,521 | 9/1973 | Breslow et al. | 273/243 |
| 3,889,954 | 6/1975 | Malisow | 273/274 |
| 3,936,054 | 2/1976 | Garcia | 273/243 |

*Primary Examiner*—Edward M. Coven
*Assistant Examiner*—Benjamin Layno
*Attorney, Agent, or Firm*—Larson and Taylor

[57] ABSTRACT

A board game incorporating various gambling methods is disclosed. A player uses either a card game similar to blackjack or a slot machine to determine the number of spaces to be moved along a segmented path, the particular game being selected by the instructions contained in the segment on which the player landed on the prior move. Each segment also contains further instructions, some of those instructions designating a further gambling apparatus and giving odds. These further apparatuses are a roulette game or a dice game, and the player landing on that segment may gamble at these games at the designated odds. Other players can join in the gambling when the roulette game and the dice game are played. The objective of the game is for a player to avoid penalties designated on the game board, acquire a majority of the playing chips until either all of the other players become "busted" or the casino bank becomes "busted".

19 Claims, 2 Drawing Sheets

CASINO BOARD GAME

FIELD OF THE INVENTION

The present invention relates to board games, and in particular relates to a casino-type of board game involving selected gambling equipment.

BACKGROUND OF THE INVENTION

People have always been fascinated with gambling. In fact, Las Vegas, the gambling capital of the world, bases its existence on the fact that people take chances with the aspirations of achieving great gains. Many people consider gambling at a casino to be both fun and entertaining, however, the economic effects can be disastrous. On the other hand, many people do not have the opportunity nor the desire to travel to the few gambling meccas in order to satisfy their thrill for gambling. Many of these people would be satisfied staying at home and enjoying the thrill and excitement of casino gambling except for the tremendous cost involved in assembling all of the different types of gambling equipment.

While there have been some board games disclosed in the prior art which are addressed in one manner or another to a game of gambling, there does not appear to be any such board game which encompasses a structured approach to the casino gambling environment. For example, the U.S. Pat. No. 3,889,954 to Malisow discloses a board game involving the use of cards, a roulette wheel or dice to determine the payment that a player must make when landing on a particular spot. However, this game does not use gambling or chance taking apparatus to play the particular gambling games themselves.

SUMMARY OF THE INVENTION

The present invention provides a family board game that simulates the excitement of a gambling casino brought directly into the family home. The present game incorporates non-repetitive play, chance, logic, and intelligent decision making, should retain the interest of all players for an extended length of time, and can be adjourned and then reassumed.

The present invention interrelates various traditional gambling games, including roulette, craps, blackjack, and slot machine through a game board. In a preferred embodiment, the basic gambling procedures of each gambling game have been modified and simplified so that the games can be related through a board and so that the players are not overburdened. The present invention is suitable for people of all ages who can read. Under the preferred embodiment, there is voluntary and involuntary interactions between the players, regardless of their advantages or disadvantages, as a result of the instructions specified on the various board spaces. Players can bet against each other and the winning and losing of chips produces the aura of a casino.

Under a particular embodiment of the present invention, various colored squares, some with and some without instructions, comprise a path of progression and determine the fate of each player. Some of the spaces afford the player his or her freedom of choice, while other spaces provide rewards and penalties. Interaction between the players occurs most frequently whenever the player lands on a space in which there are specific instructions relating to one of the games. According to this specific embodiment of the invention, bets are made by placing chips on the appropriate numbered spaces on the game board, and the players proceed to play roulette or dice according to the rules of the game. The initial forward movement around the path of the board is determined by numbers displayed on a deck of cards or by a number selected by a slot machine. An option given to the players at the start of the game is the number of chips to be put in play, thereby providing an option to shorten or lengthen the game, accordingly. Furthermore, chips may be borrowed in exchange for credit cards from other players and a game is won when a player acquires a majority of the playing chips while maintaining an advantageous position.

Figure 1:
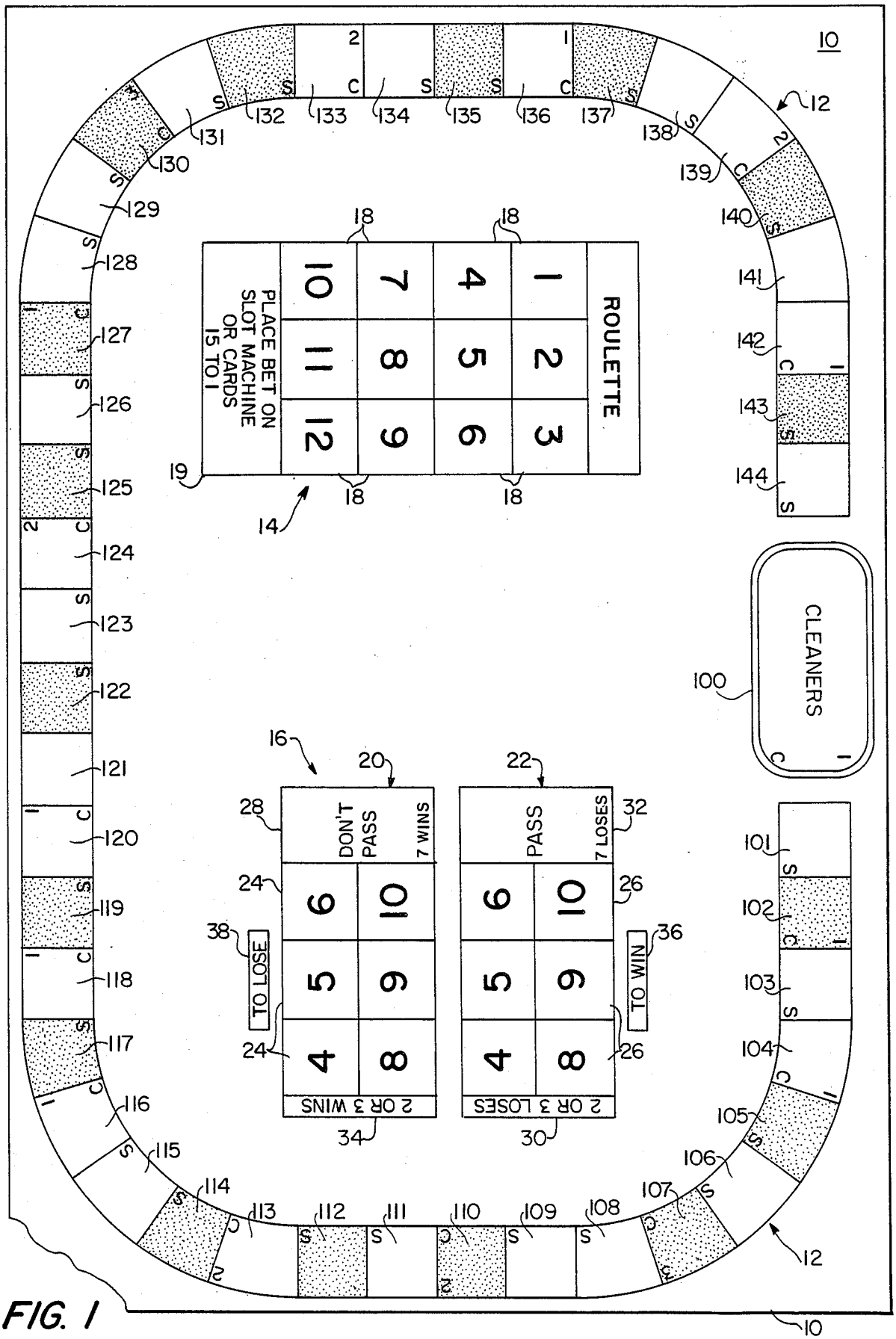
FIG. 1 is a plan view of the game board according to the present invention.

Referring now to the figures in which like numerals are used for like elements throughout the several views, a board gambling game according to the present invention is depicted in one specific embodiment thereof. With particular reference to FIG. 1, a board 10 made of a rigid material, such as cardboard having a glazed laminated surface, is depicted with a plurality of marked spaces forming a path 12 in the form of a letter "C". Path 12 has a total of 44 spaces or boxes, individually labelled using the numerals 101 through 144, with boxes 101 and 144 being located at the respective ends of the "C" of path 12. Located between end boxes 101 and 144 of path 12 is a race track shaped space 100 bearing the label "CLEANERS." Located inside path 12 are two playing areas, a roulette playing area 14 and a dice playing area 16. Roulette area 14 is comprised of twelve boxes 18, each one of which bears a number from 1 to 12, and area 19 used in conjunction with the slot machine and deck of cards. Dice area 16 is comprised of two rectangular board spaces 20 and 22, which are respectively comprised of three internally located boxes 24 and 26, respectively, arranged in two rows and two rectangular end boxes 28 and 30 and 32 and 34, respectively. The six boxes 24 and six boxes 26 in board spaces 20 and 22 are labelled with the following numbers: 4, 5, 6, 8, 9, and 10. Board space 20 is the "DON'T PASS" dice playing section and board space 22 is the "PASS" dice playing section. In end space 28, there is the additional indicia of "7 WINS" and in end space 32 there is the indicia "7 LOSES". End spaces 30 and 34 respectively contain the indicia "2 OR 3 LOSES" and "2 OR 3 WINS".

The boxes which comprise path 12 are either light or dark in coloring. The dark boxes contain either a letter "S" representing a slot machine or the letter "C" representing cards. The light colored boxes contain instructions and may or may not contain the letters "C" or "S". The letters S and C may be replaced with a symbolic picture of a slot machine or deck of cards. Those boxes which contain the letter "C" also contain a number from 1 to 3, indicating the number of cards to be dealt, as explained in greater detail hereinbelow. In the present embodiment, the following dark boxes contain the letter "C" and the number indicated in parenthesis following the box number: 102(1); 107(3); 110(2); 127(1); and 130(3). The following dark boxes contain the letter "S": 105; 112; 114; 117; 119; 122; 125; 132; 135; 137; 140; and 143. The following light colored boxes contain the letter "C" and a number which is shown in parenthesis following the numeral representing the box: 104(1); 113(2); 116(1); 118(1); 120(1); 124(2); 133(2); 136(1); 139(2); and 142(1). The following light colored boxes have the letter "S" therein: 101; 103; 106; 108; 109; 111; 115; 123; 126; 128; 129; 131, 134; 138; and 144. Those light colored boxes which do not contain either of the two letters instruct a player landing on those boxes, as more fully set forth hereinbelow, to take some other type of action. These boxes includes the following: box 121 which reads "BIG LOSS, GO TO CLEANERS"; and box 141 which reads "CHOOSE 2 CARDS OR SLOT MACHINE." The remaining light boxes contain legends or instructions which can be broken into four broad categories or groups. One group of legends tells the player who lands on that box to go to either the dice game or the roulette game. The box also provides the odds if the player wins and further provides whether the player is entitled to a bonus. The next group of legends instructs a player landing on that box to place a bet. The third group of legends tells a player to change the number of chips that players has by winning chips, losing chips or paying chips to another player. The last group of legends instructs the player landing on the box to make an additional move. These instructions are set forth below by category in tabular form wherein the number refers to the box number and in the "GO TO GAME" category, the odds to be won by the player follows the command.

| Box No. | Legend |
|---|---|
| | GO TO GAME |
| 101 | GO TO ROULETTE WHEEL, 12 to 1 |
| 103 | GENEROUS TIP GETS UNLIMITED PULLS UNTIL MATCH |
| 104 | GO TO DICE TABLE, 8 to 1 |
| 108 | GO TO ROULETTE WHEEL, 8 to 1 |
| 111 | GO TO DICE TABLE, 6 to 1 |
| 113 | GO TO DICE TABLE, 3 to 1, 10 Chip BONUS |
| 116 | GO TO ROULETTE WHEEL, 6 to 1 |
| 123 | GO TO DICE TABLE, 4 to 1 |
| 126 | GO TO ROULETTE WHEEL, 10 to 1 |
| 129 | GO TO DICE TABLE, 7 to 1 |
| 133 | PLAY ROULETTE, 4 to 1, BONUS 10 to 1 |
| 136 | GO TO ROULETTE WHEEL, 5 to 1 |
| 138 | GO TO DICE TABLE, 5 to 1 |
| 141 | CHOOSE 2 CARDS OR SLOT MACHINE |
| | PLACE BET |
| 115 | BET 4 CHIPS AGAINST NEXT ROULETTE PLAYER |
| 139 | BET 4 CHIPS AGAINST NEXT DICE PLAYER |
| | CHANGE CHIPS |
| 106 | YOU WIN 2 CHIPS AT WHEEL OF FORTUNE |
| 109 | YOU WIN 2 CHIPS FROM EACH PLAYER |
| 120 | SILENT PARTNER STACKS YOU 4 CHIPS |
| 124 | YOU LEAVE BACCARAT GAME, TIP CROUPIER 3 CHIPS |
| 128 | YOUR CHECK BOUNCED LOSE CREDIT CARD |
| 131 | PAY EACH PLAYER 2 CHIPS |
| 142 | YOU LOSE 5 CHIPS AT POKER |
| 144 | REDEEM LOST OR CASHED IN CREDIT CARD |
| | MOVE |
| 118 | POOR ROOM SERVICE MOVE AGAIN |
| 121 | BIG LOSS GO TO CLEANERS |
| 134 | NO HOTEL RESERVATION MOVE BACK, PULL UNTIL MATCH |

It will be understood by those of ordinary skill in the art that the above instructions designated in each light box are not limited to the above and may be revised within the scope of the invention.

Figure 2:
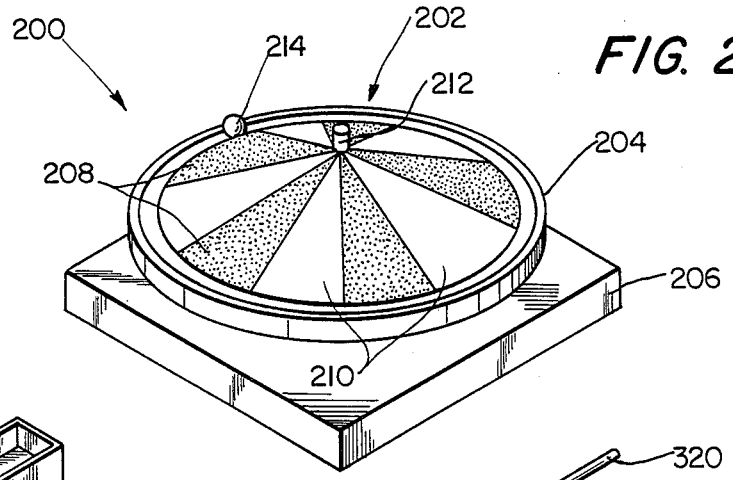
FIG. 2 is a perspective view of a roulette wheel.

With reference now to FIG. 2, a roulette game 200 is depicted. Roulette game 200 comprises a rotatable wheel 202 mounted inside a shell 204, which in turn is mounted onto a base 206. The components of roulette game 200 can be made from any conventional material, such as a durable plastic.

Roulette wheel 202 is divided into 14 total sections which are alternately colored, thus providing 7 colored sections 208, shown by stippling, and 7 plain sections 210. Six each of colored sections 208 and plain sections 210 are provided with a number from 1 to 12. One colored section and one plain section is left blank without a number.

The roulette game also includes a vertical metal shaft 212 which connects wheel 202 onto shell 204 and base 206. To prevent roulette game 200 from slipping, a non-slip grip type material can be attached, for example, by laminating, to the bottom surface of base 206. Furthermore, a conventional ball or marble 214 is used to fall into one of the slotted sections 208 or 210 in a conventional manner. Roulette game 200 is similar, except for the number of sections, to any one of a number of roulette games which are presently, commercially produced.

Figure 3:
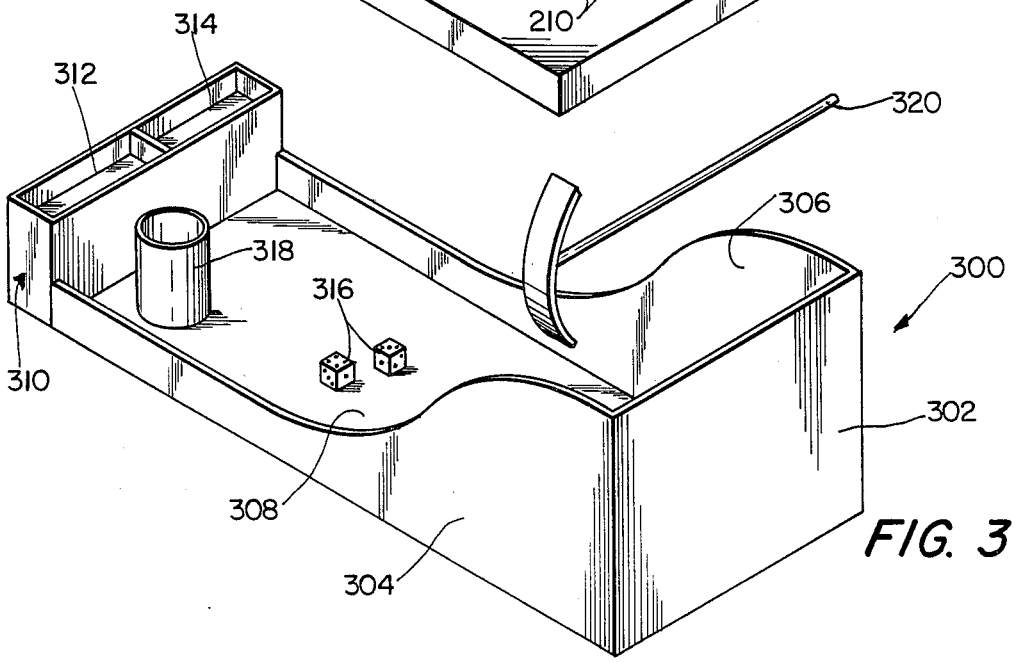
FIG. 3 is a perspective view of a dice rolling table.

With reference now to FIG. 3, a dice rolling table 300 is depicted for use with a dice game or "craps." Dice table 300 is partially enclosed on three sides with an end wall 302 and two side walls 304 and 306, which together make up the cheek walls of dice table 300. Dice table 300 also is provided with a bottom 308, preferably covered with a felt or similar material, and a container section 310 that is integral with side walls 304 and 306 and bottom 308, and which in turn contains two transversely extending compartments 312 and 314. Compartments 312 and 314 are for holding the accessories of the game. These accessories include a pair of dice 316, a dice shaking cup 318, and a number of other accessories depicted in FIG. 5 and described hereinbelow. Dice table 300 is also provided with a croup stick 320 having a handle 322 and a blade 324. The length of croup handle 322 and the width of croup blade 324 are selected so that croup stick 320 can be contained inside dice table 300. In addition, the size of board 10 (FIG. 1) is selected such that after being folded, for example, it will have essentially the same size as bottom 308 and can fit inside dice table 300.

Dice table 300 can also have a non-slip grip type material attached to the bottom surface thereof so that it will remain relatively stationary while the game of dice is being played. In addition, both roulette game 200 and dice table 300 can be capable of being disassembled, for example by having wheel 200 being removable and by having dice table walls 302, 304 and 306 being detachable from bottom 308, so that packing and storage can be facilitated inside a carton (not shown). Alternatively, as suggested above, dice table 300 can have a size so that it can serve as the packing container. In that case, roulette game 200 must have a size so that it can fit inside dice table 300.

Figure 4:
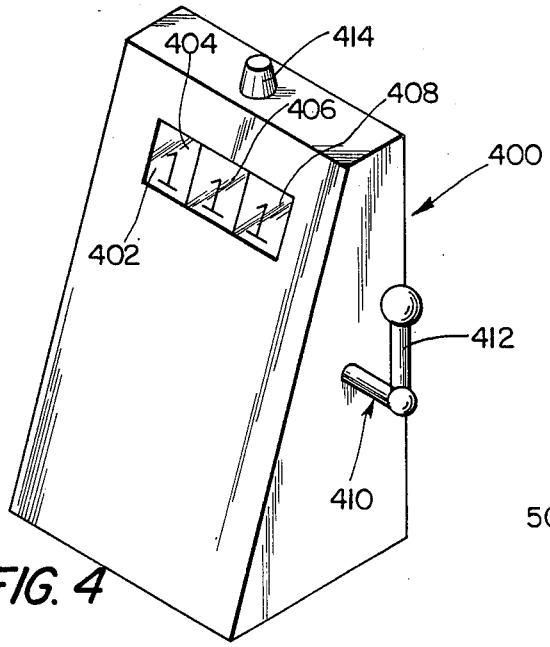
FIG. 4 is a perspective view of a slot machine.

With reference now to FIG. 4, a slot machine 400 is depicted. Slot machine 400 has a window 402, preferably made of a clear, transparent material and which covers three rotatable wheels 404, 406, and 408, which are mounted inside machine 400. Wheels 404, 406 and 408 are provided with a plurality of numbers from 1 through 6 and are spun when a handle 410 is rotated.

Slot machine 400, with the exception of the numbers on wheels 404, 406 and 408, can be a conventional slot machine whose interior mechanical parts are made of metal and whose outer housing is constructed of a durable plastic material. A non-slip grip type material can also be attached to the bottom of slot machine 400. Furthermore, to allow for necessary repairs, the back panel of machine 400 can be removable and handle 410 can be provided with a rubber hand grip 412.

When handle 412 is rotated or pulled, the wheels 404, 406 and 408 are rotated in a conventional manner through conventional linkage and are individually stopped after a plurality of rotations. When stopped each wheel displays a number which is visible through window 402. Whenever a match of three numbers is obtained, a light 414 having an appropriate portable power source, such as conventional dry cell batteries, is lit. Light 414 can be mounted at any location on slot machine 400 and is shown mounted on the top thereof in FIG. 4. As an option to selecting the size of the game board, dice table and croupier stick as previously disclosed, the roulette wheel 200, dice table 300, slot machine 400 and deck of cards 508 would be sized small enough, without inhibiting their function, to fit in combination on a lazy susan located in the center of the game board 10 between areas 14, 22, 100 and 124. The size of the game board will be selected appropriately. The rotation of the lazy susan will enable each gambling apparatus to face all designated players.

Figure 5:
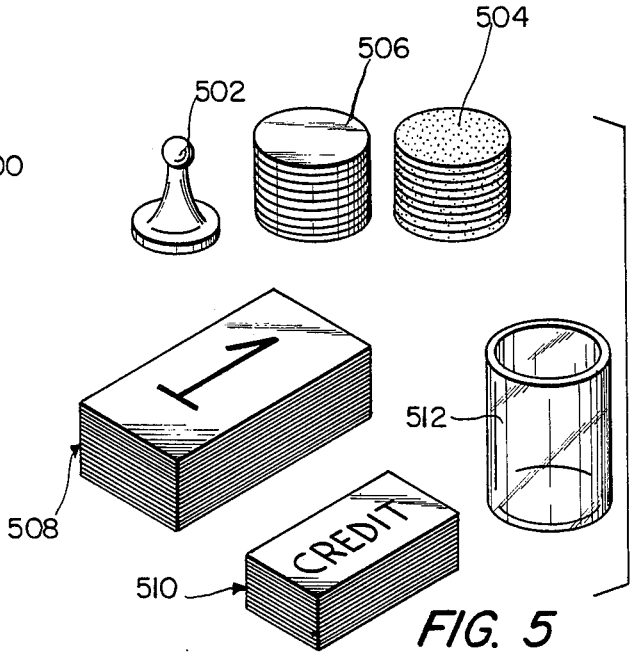
FIG. 5 is a collection of elements, each in perspective view, which are used when playing the board game.

With reference now to FIG. 5, several accessories used in playing the gambling game are depicted. These accessories include playing markers or pegs 502 (only one of which is shown) which can be made of any rigid material such as wood or plastic, can be weighted and have a durable finish, and can have a laminated felt-type material on the bottom. A number of playing pegs are provided, but there must be one peg for each player or participant. Each peg is colored with a different color, which can include but are not limited to, red, yellow, orange, green, blue and brown. Also depicted in FIG. 5 are a plurality of groups of differently colored wagering means such as playing chips 504. Chips 504 have the same colors as corresponding playing pegs 502. In addition, additional wagering means are represented by a plurality of white chips 506, one of which will equal a certain number of colored chips such as five (5). A deck of 34 playing cards are indicated at 508. Twenty-seven of the playing cards have a number from 1 through 8 imprinted on one side and have a design imprinted on the other side. The balance of the cards will have the number 0 on the cards and four of them will have the following instructions:

| |
|---|
| LOSE TURN |
| MOVE BACK TEN SPACES |
| LOSE 8 CHIPS |
| COLLECT CHIPS EQUAL TO NUMBER ON NEXT CARD DRAWN |

Obviously, other instructions can be utilized and the number of cards, the numbers imprinted on the cards, the number of cards having a 0 and the number of cards having instructions can vary. Finally, a plurality of credit cards 510 are depicted in FIG. 5. Credit cards 510 are equal in number to the number of playing pegs 502 and an exemplary number can be four. Cards 510 are used by the player to borrow a certain number of chips, such as five, as set forth in greater detail hereinbelow. A clear plastic cylinder 512 used by the croupier to spot the winning chip(s) completes the accessories in FIG. 5.

OPERATIONS, RULES AND REGULATIONS

The basic operation of the game, rules and regulations including a detailed explanation of the purpose and use of the various game implements will now be discussed.

The object of the game is to accumulate as many chips as possible by gambling and by winning chips without going "busted." The player having the largest number of chips when the casino bank goes busted wins or the last player after the other players have gone busted wins.

Before beginning the game, the colored playing chips are divided into two piles, a first pile which is distributed in equal numbers to the players, each player having his or her own colored chips, and a second pile which becomes the "casino bank." The colored chips in the casino bank are used to pay the winners at the different gambling apparatuses. The white chips represent a multiple number of the colored chips, for example one white chip equals five colored chips. Prior to the start of the game, each player is allocated a number of colored playing chips, such as 10, one peg of the same color as the playing chips, which is used to mark the player's location on the game board, and one credit card. In order to control the length of the game, the players must decide on the number of white chips to be placed into the casino bank. For example, 20 white chips used in a game with an average amount of gambling will usually last about 1½ hours. If there are only a few players, then only colored chips need be utilized, and the white chips can be used only as change for the players.

To start the game, the playing pegs 502 are all placed in CLEANERS space 100 and roulette wheel 202 is spun by each player to determine the order of play. The player obtaining the highest number plays first, the next highest number plays second, etc. If the same number is obtained by more than one player, the wheel is spun again until the tie is broken. One player is chosen as croupier, and he may or may not be a gambler. If one of the gamblers is to be the croupier, then the croupier can also be chosen by spinning the roulette wheel. The croupier is responsible for handling the casino bank, paying and receiving the appropriate number of chips, exchanging chips between players and the casino bank, and removing chips from the game board.

After the order of play has been determined, the first player moves the number of spaces or boxes equal to the number received when roulette wheel 202 was spun. After that, the number of spaces transversed is determined by either the card game or the slot machine, in a manner to be described.

If a player lands on a box having the letter "C", the future advance of that player (i.e., at the next turn of the player) is determined by the card game. The card game is played similar to blackjack, except that the maximum number of points is 10 instead of 21 as in blackjack. The croupier gives the player the number of cards designated on the particular box on which the player has landed. For example, if the player has landed on box 110, the player receives 2 cards. If the number on the cards drawn totals 10 or less, that player then moves his peg that number of boxes. For example, if the player draws a card having the number 7 and a card having the number 2, the player has received a total point count less than 10, namely 9, and the player moves a total of 9 boxes (or to box 119 in this example). Should the number of cards drawn exactly total 10, then the player not only moves 10 boxes, but also receives a designated number of colored chips, such as 5, of his allotted color from the casino blank. However, if the numbers on the cards drawn total to more than 10, the player has "busted" that hand and loses his or her turn. If the first card drawn by the player is a "0" then the player must comply with the instructions on the card. However, if the first card is not a "0", but the second or third card is a "0", then the player does not have to comply with the instructions, but rather uses the number "0" when totalling the cards. After the last card is drawn, or when there are insufficient cards to give a particular player, all of the cards are reshuffled and then reused.

Slot machine 400 is the second apparatus used by the players to determine their progress around path 12 of the game board 10. Should a player land on a square or box having a letter "S" imprinted thereon, when it is the player's next turn, the player goes to the slot machine and has three chances to match two or three numbers. A match of any two numbers allows the player to move that many boxes on the board. For example, if the numbers that come up are 2-5-5, the player moves 5 squares. If the player matches all three numbers, the player must move that number of boxes. In addition, 414 is illuminated and the croupier pays the player a designated number of chips, such as 5, from the casino bank. For example, if the number on slot machine 400 reads 3-3-3, the player moves 3 squares and receives 5 chips of the player's allotted color from the casino bank. If the player does not achieve a match of any numbers during the three pulls, the player loses his or her turn and must wait for all of the other players to complete their moves before trying again.

As an additional feature, wagers may be placed upon the outcome of dealing the cards or pulling the slot machine. If it is believed that a match of three numbers will occur on the slot machine or the amount of cards drawn will total ten (10), a player places his or her chips in area 19 on the game board, PLACE BETS ON SLOT MACHINE OR CARDS (15 to 1). All players including the player whose fate is in question may participate allowing for bets to be changed between procedures. The casino bank pays any winner or winners at the indicated odds and the croupier removes the chips from the board.

After the initial game move of a player (which as mentioned above is determined by the roulette wheel), the subsequent number of boxes traversed by the player is determined by the card game or the slot machine, as mentioned above. After moving the designated number of boxes with the player's peg, the player then follows the instructions of the box on which he or she has landed.

If that square instructs the player to play either roulette game 200 or dice game 300, the player has another means by which he or she can acquire additional playing chips. In roulette game 200 the player can bet against the house or casino bank, as well as against other players. If a player lands on an appropriate square, such as box 108, the player may go to the roulette wheel and play at 8 to 1 odds. If the player elects to play, he or she bets the desired number of chips by placing the chips on one or more numbers in roulette area 14 on board 10. The croupier then spins the roulette wheel in one direction and ball 214 in the other direction around shell 204. If the croupier is one of the players, then each player spins the roulette wheel himself or herself. First, the player plays alone, or unopposed and is given a predetermined number of chances, for example two chances, to win by having ball 214 land in a numbered slot on which the player had bet. In such a case the player wins a number of chips from the casino bank that is equal to the number of chips bet times the odds given. However, if the roulette ball 214 lands in a blank space, the player loses the amount bet and his or her turn. If the player does not win in the unopposed tries, all of the other players have the option to join in on the roulette game and place bets on one or more numbers. Players are allowed to bet on the same number and also are permitted to change numbers between spins. The roulette game continues with involved players until there is a winner or until the roulette ball 214 lands on a blank spot. If no other players opt to join the roulette game, the originally designated player is given a predetermined number of additional chances to win, for example, three, but the player can still lose if the roulette ball lands on a blank spot. Win or lose, the player must then wait for his or her next turn, at which time the player will go to the card game or the slot machine as instructed on the box on which he or she had landed to determine the number of spaces to move. In the above example the player having landed on box 108 on the previous turn, the player would go to the slot machine when the player's turn arises again.

The croupier spots any winning chips by placing the clear plastic cylinder on top. All other chips are removed from the board with croup stick 320 and are deposited into the casino bank. The casino bank then pays the winner or winners at the indicated odds, which as mentioned above for box 108 is 8 to 1.

The dice game, which uses dice table 300, is yet another means by which players can acquire additional playing chips. In the dice game, the others are allowed to bet with or against the player with the casino bank paying the winners and collecting the bets of the losers. As in playing roulette game 200, the odds used for playing dice game 300 are determined by the box on which the player has landed. For example, if the player has landed on box 111, the odds are 6 to 1. The player landing on this box becomes the Shooter and has the option to bet "PASS" or "DON'T PASS" before the first dice roll is thrown. After making this choice, the player places the number of chips to be bet on the corresponding square in dice area 16 on board 10. If the Shooter uses a "PASS" bet, the Shooter wins if the first roll is a seven (7) or eleven (11) and loses if it is "Craps", which is the number two (2) or is the number three (3). If the Shooter does not roll a 2, 3, 7 or 11 on the first throw, the total of the remaining spots on the dice becomes the Shooter's "COME" point. Thus, the COME point is a 4, 5, 6, 8, 9 or 10, and must be thrown before a seven (7) in order for the Shooter now to win. On "DON'T PASS" bets, a two (2) or a three (3) wins on the first roll and a seven (7) or an eleven (11) loses. A Shooter must throw a seven (7) before rolling the player's "DON'T COME" point in order to win.

The opposing players do not bet on the first roll in the dice game. If a "PASS" or "DON'T PASS" bet is won or lost on the first roll, the dice game is over. If a "COME" or "DON'T COME" point is thrown, the Shooter removes his or her chips from the "PASS" or "DON'T PASS" square and places them on the outside line of the numbered box that corresponds to the player's point. At this time, the other players may participate in the dice game by betting with or against the Shooter. If the other players believe that the Shooter will make his or her point, that player places his or her chips in the square labelled "PASS." On the other hand, if the other player does not believe that the Shooter will make his or her point, the other player places his or her chips in the "DON'T PASS" square. In addition, all players including the Shooter may make a one time "place to win" or "place to lose" bet on any number except the Shooter's point. Thus, five out of the six numbered squares in board spaces 20 or 22 can be used. If it is believed that the Shooter will throw a number before a two (2) or a three (3), the player places his or her chips on that number in board space 22 labelled the "TO WIN" space in an area 36 located therebelow. If the player believes that a two (3) or a three (3) will be thrown first, the player places the desired number of chips on a numbered box in the board space 20 labelled "TO LOSE" in an area 38. If a player's bet is lost, the player's chips are removed from the board and deposited into the casino bank. If a player wins, all remaining bets lose and Place Betting is concluded. After all bets are made, the Shooter continues to throw the dice, allowing for the amount of chips bet to be changed between rolls, until the player wins or loses his "PASS" or "DON'T PASS" bet. At such time, the dice game is over and any Place Bet not won is lost. The croupier spots the winning chips by placing clear plastic cylinder 318 over them. All other chips are removed from the board with croup stick 320 and are deposited into the casino bank. The croupier then pays the winners at the indicated odds from the casino bank. In the present example, where the Shooter landed on box 111, the indicated odds are 6 to 1.

The credit cards 510 issued one to a player at the beginning of the game have a predetermined, designated value such as five playing chips. At any time during the game, on a one time option, a player may surrender his or her credit card 510 to the casino bank in exchange for the designated number of playing chips. In addition, should a player land on box 128, the player loses his or her credit card.. On the other hand, should the player land on box 144, the player would be able to redeem a lost playing card.

The game board 10 is the link between the four gambling methods, roulette game 200, dice game 300, slot machine 400, or the card game using cards 508. After the instructions contained within a box on which a player has landed are read, the player has the option of not following those instructions if those instructions are specifically related to playing either roulette game 200 or dice game 300. If the player so opts, the player then loses his or her turn and is prohibited from betting against the other players until after that player's next successful move. Unless involuntarily unable to, the player must comply with all other instructions, and the player is liable until his or her peg 502 is moved from such square. If the instructions in the box involve paying or losing chips, and a player has the same or less than the amount to be dispensed, the player is considered "busted" and out of the game. Similarly, if a player is instructed to bet and has less than the designated amount of chips, the player is busted and out of the game.

The racetrack space 100 labelled "CLEANERS" is considered a square that is counted when the player is moving. Should a player land in CLEANERS space 100, or is instructed by landing in box 121 to go to CLEANERS, the player loses a specific amount of chips such as five (5) which must be surrendered to the casino bank. Should a player who lands on or is instructed to go to CLEANERS space 100, have less than the 5 chips to be surrendered, the player must either cash in his or her credit card 510, if the card has not been previously surrendered or is "busted" and is out of the game.

Should a player not land on CLEANERS area 100, but rather pass the area, the player receives a designated number of chips (for example 5) from the casino bank. When a player lands on a square relating to receiving chips from or paying chips to opposing players, the exchanges are made through the casino bank so that each player maintains his or her designated color of chips. Where additional instructions direct players to give up or receive chips, the casino bank is also used for that purpose.

There are two other possible ways of a player becoming "busted.". If all accumulated playing chips exceeding ten (10) or exceeding twenty(20) must be surrendered to the casino bank in accordance with an instruction and a player has less than ten (10) or twenty (20) chips, respectively, the number of chips received after cashing in his "credit card" must increase the total amount of chips held to more than ten (10) or twenty (20), respectively. If not, the player is considered "busted." In addition, other players can land on boxes which contain instructions that require the other players to surrender additional chips to that player or to require the player who has landed on the box to place a bet. Should the player be unable to comply, the player is busted.

Should a player land on a box that includes a "BONUS," such as box 113 for dice game 300 or box 133 for roulette game 200, the game is played, using the 3 to 1 odds, as previously described in the disclosure. If the player landing on box 113 wins, he then collects an additional 10 chips from the casino bank. If the player landing on box 133 wins, the casino bank pays him 10 to 1 odds on the same winning number of chips.

As the game proceeds, some players may accumulate playing chips while others may not. A player losing all of his or her chips is considered "busted" and is out of the game. If one player remains after all the other players have become "busted", that player is the winner. Alternatively, when the casino bank has been depleted of all of its supply of white chips and one complete set of color chips, the house is considered broken and the game is over. The player at that time having the highest count of chips is considered the winner.

Now that the basic concept of the present invention has been described in detail hereinabove with respect to an exemplary embodiment thereof, it will be understood by those of ordinary skill in the art that variations and modifications may be affected within the scope and spirit of the invention. For example, path 12 can have greater or lesser number of boxes; the use of other gambling apparatuses may be employed; and the shape of path 12 can be changed. Furthermore, the exemplary number of chips, cards, total number of cards given, the values of the cards, and the numbers on the roulette wheel can be changed. Furthermore, other forms of determining the number of spaces to be moved, for example by using dice, can be employed. In addition, cards 508 can also be used to play a game of blackjack (in a modified or unmodified form) with other players being able to bet on that game instead of or in addition to determining the number of squares to be advanced.

In addition, the present invention can be implemented on a preprogrammed computer and used in conjunction with the computer video equipment. Obviously, the interaction between the players occurs most frequently whenever a player's peg comes to rest on a square with specific instructions relating to playing the roulette game or the dice game. However, the interaction can be increased by also permitting other players to bet on the card game or slot machine as to whether the player operating those games will win or lose.

In any event, the scope of the invention is indicated by the following claims and those changes which come within the equivalent scope and spirit of these claims.

I claim:

1. A board game for one or more players for playing a plurality of games of chance, the game comprising:

a game board having a plurality of undivided spaces which together define a circuitous path;

a board marker for indicating the board position of a player;

a plurality of wagering means for betting by the players;

chance means providing a chance selection of at least one game for determining the progression around said path, said chance means further providing a chance selection of at least one game usable for wagering by all players so that a player can increase the amount of that player's wagering means; and a plurality of individual, independent, selectable means for providing instructions, said means divided into at least a first group for instructing the player which game to use to determine the progression, and a second group for instructing the player which wagering game to use and the odds to determine a winning payoff.

2. A board game as claimed in claim 1 wherein the particular ones of said first group and said second group of instruction means are selected based on the space on which a player has landed.

3. A board game as claimed in claim 2 wherein said instruction means comprises indicia that are individual to and imprinted on said spaces.

4. A board game as claimed in claim 3 wherein said spaces are divided into a first category which have said instructions indicia imprinted thereon and a second category of spaces which have no such instructions indicia.

5. A board game as claimed in claim 4 wherein said instructions indicia and said first and second categories of spaces are randomly distributed in said path.

6. A board game as claimed in claim 1 wherein said path has a general racetrack shape.

7. A board game as claimed in claim 6 wherein said game for wagering involves the selection of one of a plurality of numbers; and wherein said board includes at least one area inside said path which contains a plurality of numbered spaces on which said wagering means can be placed to indicate the number selected by the player.

8. A board game as claimed in claim 1 and said chance means further including an additional game of chance; and wherein said first group of instruction means indicate which one of at least two of said games of chance is to be used to determine the progression around the board.

9. A board game as claimed in claim 1 and said change means further including an additional instruction means game of chance; and wherein said second group of indicate the odds and which one of at least two of said games of chance is to be played by all of the players for wagering.

10. A board game as claimed in claim 1 and further including two additional games of chance; and wherein said first group of instruction means select one of a first set of two of said games and wherein said second group of instructions select one of a second set of games comprised of the other two of said games.

11. A board game as claimed in claim 10 wherein said first set of games are a card-type game and a slot machine type game and wherein said second set of games are a dice-type game and a roulette type game.

12. A board game as claimed in claim 1 wherein said at least one of said games involves the selection of one of a plurality of numbers; and wherein said board includes at least one area inside said path which contains a plurality of numbered spaces on which said wagering means can be placed to indicate the number selected by the player.

13. A board game as claimed in claim 12 wherein said board area containing numbered spaces further includes a space for receiving said wagering means to indicate that the player will get a predetermined value upon operating the game of chance used to determine the progression around said path.

14. A board game as claimed in claim 1 and further including a credit means for each player for permitting said player to obtain a predetermined number of wagering means in exchange therefor.

15. A board game as claimed in claim 1 wherein said instruction means further includes a third group for instructing the player to change the amount of that player's wagering means.

16. A board game as claimed in claim 15 wherein said instruction means further includes a fourth group for instructing the player to move to a predetermined space.

17. A game for a plurality of players for playing a plurality of wagering games utilizing a game board for determining the game rules and selection, said game comprising:

a game board having a plurality of individual spaces which together form a path of progression;

a plurality of board markers, each marker individual to a player, for marking the progression of the players;

first, second and third different wagering apparatuses;

first selecting means usable by a player during that player's turn for selecting one of said wagering apparatuses to be used to determine the progression of that player's marker along said board path and second selecting means usable by a player during that player's turn for selecting which one if any, of said wagering apparatuses to be used by all players for wagering.

18. A board game as claimed in claim 17 wherein said first selecting means comprises instructions imprinted on each space.

19. A board game as claimed in claim 18 wherein said board spaces are divided into a first category and into a second category; and wherein said second selecting means comprises instructions imprinted only on said first category of spaces.

* * * * *